United States Patent [19]

Suematsu et al.

[11] Patent Number: 4,680,245

[45] Date of Patent: Jul. 14, 1987

[54] ELECTROPHOTOGRAPHIC POSITIVELY CHARGEABLE DEVELOPER CONTAINING SILICA TREATED WITH A NITROGEN CONTAINING SILANE COUPLING AGENT AND METHOD OF DEVELOPING

[75] Inventors: Koshi Suematsu, Kawasaki; Eiichi Imai, Narashino, both of Japan

[73] Assignee: Canon Kabushiki Kaisha, Tokyo, Japan

[21] Appl. No.: 929,495

[22] Filed: Nov. 12, 1986

Related U.S. Application Data

[63] Continuation of Ser. No. 596,090, Apr. 2, 1984, abandoned.

[30] Foreign Application Priority Data

| | | | |
|---|---|---|---|
| Apr. 12, 1983 | [JP] | Japan | 58-63935 |
| May 31, 1983 | [JP] | Japan | 58-96511 |
| May 31, 1983 | [JP] | Japan | 58-96512 |
| Jun. 22, 1983 | [JP] | Japan | 58-112411 |
| Jun. 23, 1983 | [JP] | Japan | 58-113965 |

[51] Int. Cl.[4] ..... G03G 9/08

[52] U.S. Cl. ..... 430/110; 106/308 N; 438/404; 430/122

[58] Field of Search ..... 428/404, 405; 106/308 N; 430/110, 122

[56] References Cited

U.S. PATENT DOCUMENTS

| | | | |
|---|---|---|---|
| 3,229,419 | 4/1973 | Honjo et al. | 430/115 |
| 3,542,681 | 11/1970 | Mutaffis | 430/115 |
| 3,551,337 | 12/1970 | Robinson | 430/115 X |
| 3,627,522 | 12/1971 | Jacknow | 430/107 |
| 3,844,966 | 10/1974 | Nelson | 430/115 |
| 4,265,197 | 5/1981 | Toyono | 430/122 X |
| 4,301,228 | 11/1981 | Kori et al. | 430/110 X |
| 4,309,498 | 1/1982 | Yamashita et al. | 430/122 X |
| 4,345,015 | 8/1982 | Hendriksma et al. | 430/110 X |

FOREIGN PATENT DOCUMENTS

| | | | |
|---|---|---|---|
| 135845 | 10/1980 | Japan | 430/110 |
| 135855 | 10/1980 | Japan | 430/110 |

*Primary Examiner*—J. David Welsh

*Attorney, Agent, or Firm*—Fitzpatrick, Cella, Harper & Scinto

[57] ABSTRACT

An electrostatic image is developed by disposing an electrostatic image bearing member which holds an electrostatic image on its surface and a developer carrying member which carries an insulating developer on its surface with a certain gap provided therebetween, at a developing section bringing an insulating developer containing a nitrogen-containing compound to a thickness thinner than the gap on the developer carrying member and transferring said developer onto the above electrostatic image bearing member at the developing section. The nitrogen-containing compound has nitrogen in the form of a heterocyclic ring and imparts stable positive chargeability to the developer.

11 Claims, 6 Drawing Figures

ELECTROPHOTOGRAPHIC POSITIVELY CHARGEABLE DEVELOPER CONTAINING SILICA TREATED WITH A NITROGEN CONTAINING SILANE COUPLING AGENT AND METHOD OF DEVELOPING

This application is a continuation of application Ser. No. 596,090 filed Apr. 2, 1984, now abandoned.

BACKGROUND OF THE INVENTION

1. Field of the Invention

This invention relates to a developing method for development of electrostatic images in electrophotography, electrostatic recording and electrostatic printing, particularly electrophotography, and a positively chargeable developer therefor.

2. Description of the Prior Art

Developing methods in electrophotography, electrostatic recording, etc. of the prior art may be classified broadly into the dry developing method and the wet developing method. The former is further classified into the method using two-component system developer and the method using one-component system developer. Those belonding to the two-component system developing method include various methods with different carriers for transporting toner, such as the magnet brush method using iron powder carrier, the cascade method using beads carrier and the fur brush method using fur.

On the other hand, those belonging to the one-component system method include the powder cloud method in which toner particles are used in atomized state; the contact developing method (also called as toner development) in which development is effected by contacting the toner particles directly with the electrostatic latent image surface; the jumping developing method in which toner particles are not contacted directly with the electrostatic latent image surface but toner particles are charged and permitted to jump due to the electrical field given by the electrostatic image toward the latent image surface; and the magnedry method in which electroconductive toner is contacted with the electrostatic latent image.

According to the two-component system developing method, a mixed developer of carrier particles and toner particles is necessarily used, and toner particles are generally consumed in amounts by far larger than the carrier particles in the course of developing procedure. As the result, the mixing ratio of both particles will be changed to cause changes in density of sensible images. Also, through deterioration of carrier particles which are hardly consumed after usage for a long time, image quality will be lowered. These are inherent drawbacks of the two-component system developing method.

On the other hand, according to the one-component system developing method, in the magnedry method using magnetic toner and the contact developing method using no magnetic toner, the toner is contacted with the whole surface to be developed, namely irrespectively of the image portion and the non-image portion. For this reason, toner is readily attached even to the non-image portion, thereby causing contamination called ground fog. (This problem of fog contamination was also similarly observed in the two-component system developing method.) Also, the powder cloud method cannot be free from attachment of the toner particles in powdery state onto the non-image portion, thus involving also the drawback that the ground fog cannot be removed.

In this respect, the developing method as proposed in Japanese Laid-open Patent Application No. 43027/1979 and No. 18656/1980, which comprises disposing an electrostatic image bearing member which bears an electrostatic image on its surface and a developer carrying member which carries an insulating developer on its surface at a developing section with a certain gap provided therebetween, carrying a developer to a thickness thinner than the above gap on the developer carrying member and transferring the developer onto the electrostatic image bearing member, has an advantage that the fog as described above will hardly appear. This method, because no carrier particle is used, causes no change in mixing ratio as mentioned above and further no deterioration of carrier particle and therefore may be stated to be an electrostatic image developing method which can give highly faithful images of stable quality.

In the jumping developing method known in the art, when copying is continued repeatedly, evenness of the developer layer carried on a developer carrier may sometimes be impaired, whereby various inconveniences may be caused. For example, coating failure in streaks in the circumferential direction of the carrier may be generated, or the thickness of the developer layer may become extremely thinner partially as compared with the initial thickness to result in generation of irregularities like speckles or generation of coating failure like ripples. The former is observed as white streaks on the image on development, while the latter as density irregularities like speckles or like ripples. This phenomenon will scarcely occur in ordinary repeated copying, but it may sometimes occur undesirably in continual use, particularly under environmental conditions of extremely low temperature and low humidity for a long term.

Also, under higher temperature and higher humidity conditions, the thickness of the developer layer may sometimes unfavorably change and become thinner in most cases, thus frequently causing lowering of image density. As the result of investigations about this point, it has been found that one cause thereof resides in insufficient stability and reliability of the charge controller component, and that characteristics of adhesion of the developing powder onto the sleeve and transfer of the developing powder from the sleeve may be changed by such causes.

Explaining in further detail, such phenomena are caused by generation of portions having uneven triboelectric charges in the developer layer carried on the carrying member due to the change in the environmental conditions. More specifically, under the environmental conditions of extremely low temperature and humidity, a component of the developer with extremely large triboelectric charges is formed through friction of the carrying member surface and the developer. Due to the image force caused by the charges, such a component with extremely large triboelectric charges is liable to be accumulated in the vicinity of the carrying member and affect influences on evenness or readiness in developing of the upper layer portion of the developer, thereby causing such irregularities as white streaks, speckle-like irregularities, and ripple patterns as mentioned above. The reduction in thickness of the developer layer at higher temperature and humidity may also be generated by uneven triboelectrification between the developer and the carrying member, namely due to instability of the amount of triboelectric charges of the developer near the surface of the carrying member.

Positive charge controllers used in toners for dry system development are generally, for example, quaternary ammonium compounds and organic dyes, particularly basic dyes and salts thereof. Positive charge controllers conventionally used are benzyldimethylhexadecylammonium chloride, decyl-trimethylammonium chloride, nigrosine base, nigrosine hydrochloride, safranine $\gamma$, crystal violet and others. Particularly, nigrosine base and nigrosine have been frequently used as positive charge controllers. These are usually added to a thermoplastic resin to be dispersed in the resin while it is molten under heating, and the resultant resin mixture is micropulverized into fine particles, adjusted to suitable sizes, if desired, and then provided for use.

However, these dyes as charge controllers have complicated structures and do not have constant properties, thus being poor in stability. Also, decomposition or denaturation may occur through decomposition, mechanical collision and friction during kneading under heat or change in temperature and humidity conditions, to cause lowering in the charge controlling characteristic.

Accordingly, when development is carried out by use of a toner containing these dyes as charge controllers in a copying machine, the dyes may undergo decomposition or denaturation as the increase in number of copies to cause deterioration of the toner during continual use.

Also, most of the substances known to be positively chargeable are generally dark in color and have a disadvantage that they cannot be incorporated in a brilliant chromatic developer.

As another vital disadvantage, it is very difficult to disperse these dyes as charge controllers evenly into a thermoplastic resin, resulting in different amounts of triboelectric charges among the toner particles obtained by pulverization. For this reason, in the prior art, various methods have been practiced in order to disperse these dyes more evenly into a resin. For example, a basic nigrosine dye is formed into a salt with a higher fatty acid for improvement in compatibility with a thermoplastic resin. In this case, however, unreacted fatty acid or dispersed product of the salt will be exposed on the toner surfaces to contaminate carriers or toner carrying member and also cause lowering in free flowing property of the toner, fog and lowering in image density. Alternatively, for improvement in dispersibility of these dyes into a resin, there is also employed a method in which dye powders and resin powders are previously mechanically pulverized and mixed before fusion kneading. This method is not competent enough to overcome the original poor dispersibility, and evenness of charging satisfactory in practical application had not yet been obtained.

Furthermore, most of dyes for positive charge controlling are hydrophilic and therefore, due to poor dispersibility of these dyes into a resin, the dyes are exposed on the toner surfaces when pulverized after fusion kneading. Accordingly, when the toner is used under highly humid conditions, a drawback that no image of good quality can be obtained is involved because of such hydrophilic nature of the charge controller.

Thus, when a dye having positive charge controller of the prior art is used in a toner, variances in amount of the charges generated on the toner particles surfaces will occur among toner particles, between toners and carriers or between toners and toner carrying member such as sleeve, whereby various inconveniences are caused, such as fogging, toner scattering, carrier contamination, etc. These difficulties become marked when a large number of copying cycles were carried out continuously, giving the results essentially unsuitable for a copying machine.

Also, most of the toners are unsuitable for use under highly humid conditions, because the transfer efficiency of the toner image is markedly lowered. Even under normal temperature and humidity, when the toner is stored for a long time, due to instability of the positive charge controller employed, most of toners may be denatured to become useless.

SUMMARY OF THE INVENTION

An object of the present invention is to provide a developing method and a developer and therefore excellent in durability such as continual use characteristic.

Another object of the present invention is to provide a developing method and a developer therefor stable even against environmental changes such as high temperature and high humidity conditions or low temperature and low humidity conditions.

Still another object of the present invention is to provide a developing method and a developer therefor which can overcome various problems concerned with the chargeable toner of the prior art and can be charged evenly and strongly to visualize the electrostatic images and give images of high quality.

According to one aspect, the present invention is characterized as a developing method, which comprises disposing an electrostatic image bearing member which bears an electrostatic image on its surface and a developer carrying member which carries an insulating developer on its surface with a certain gap provided therebetween at a developing section, bringing an insulating developer containing a nitrogen-containing compound to a thickness thinner than said gap on the developer carrying member and transferring said developer onto said electrostatic image bearing member at the developing section to develop the electrostatic image.

Particularly, it is very effective to apply the above developing method for a developing device having a sleeve roller.

Also, the insulating positively chargeable developer of the present invention is characterized by containing a nitrogen-containing compound.

In a specific embodiment, the above nitrogen containing compound takes the form of an A-B conjugate wherein A is phthalocyanine or its derivative and B is a nitrogen-containing heterocyclic ring or its derivative.

In another embodiment, the above nitrogen-containing compound takes the form of a nitrogen-containing silane coupling agent represented by the formula shown below coating fine silica particles:

$$R_mSiY_n$$

wherein R is an alkoxy group or a chlorine atom, m is an integer of 1 to 3; Y is an unsaturated nitrogen-containing heterocyclic group or its derivative and n is an integer of 3 to 1.

DETAILED DESCRIPTION OF THE INVENTION

Figure 1:
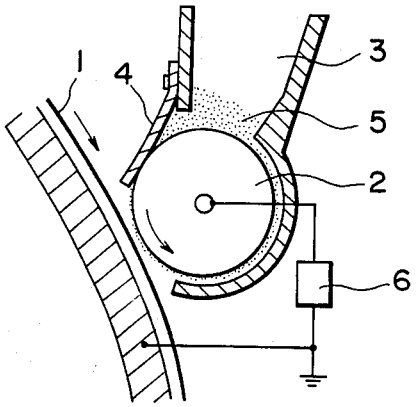
FIG. 1 through FIG. 5 respectively show a device for practicing the developing method of the invention by use of a non-magnetic developer.

One form of the nitrogen-containing compound contained in the developer of the present invention is an A-B conjugate wherein A is phthalocyanine or its derivative and B is a nitrogen-containing heterocyclic ring or its derivative. Such an A-B conjugate is stable thermally and with lapse of time and its hygroscopicity is small. Further, because it has a kind of function separation type structure comprising a color forming portion and a charge controlling portion combined with each other, it is a charge controller of good quality, of which charged quantity can be adequately controlled, while exhibiting a brilliant chromatic color.

As the phthalocyanine derivatives constituting the A-moiety, there may be included those well known in the art such as halides prepared by introduction of chlorine groups, etc. or aryl derivatives by introduction of phenyl groups, etc. Otherwise, it is also possible to introduce mercapto group, thiocyano group, cyano group, amino group, hydrocarbon group, halogenated hydrocarbon group, nitro group, sulfonic group, etc. either singly or in combination. Introduction of these groups may be effected at any of replaceable 16 sites of the phthalocyanine structure. The form like a so called sulfide dye having bonded two molecules with a disulfide group may also be used. The A-moiety can also take a form of a metal complex, and this may include, other than copper complexes generally known, complexes with various kinds of metals, but stable complexes with nickel, zinc, cobalt, aluminum, platinum, iron and vanadium are preferred.

As the nitrogen-containing heterocyclic ring constituting the B-moiety, a large number of compounds have been known in the art, and other atoms than nitrogen such as oxygen, phosphorus, silicon and sulfur may also be contained. For example, there are:

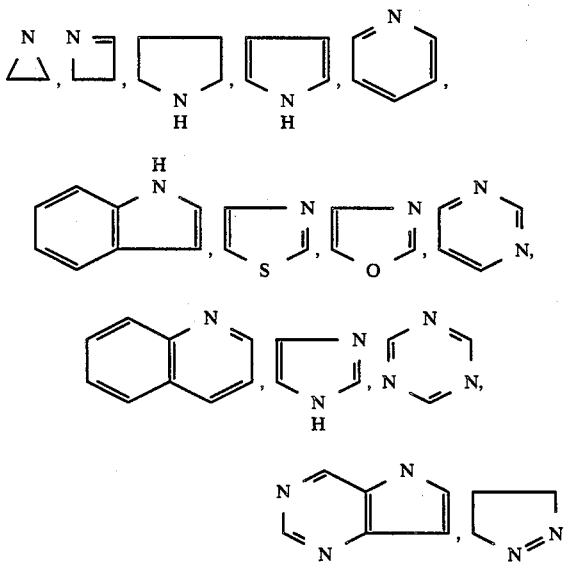

As their derivatives, there may be included those well known in the art such as halides prepared by introduction of chlorine groups, etc. or aryl derivatives by introduction of phenyl groups, etc. Otherwise, it is also possible to introduce mercapto group, thiocyano group, cyano group, amino group, hydrocarbon group, halogenated hydrocarbon group, nitro group, sulfonic group, glycidoxy group, methacrylic group, etc. either singly or in combination. Introduction of these groups may be effected at any of replaceable sites of the nitrogen-containing heterocyclic ring structure.

The above conjugate is generally effective, but the A-moiety should desirably be copper phthalocyanine or its derivative in consideration of thermal stability. Also, in consideration of charging controllability, the B-moiety should preferably be a nitrogen-containing unsaturated heterocyclic ring or its derivative.

The A-B conjugate can be obtained by bonding A and B at their replaceable sites directly or with one or more intermediate groups therebetween as shown hereinbelow. In view of the stability of the A-B conjugate against heat, light humidity etc., it is desired that the intermediate groups do not contain more than 50 atoms.

| | |
|---|---|
| Oxygene-containing complex groups | |
| $CH_3COCH_2$— | acetonyl |
| $C_6H_5COCH_2$— | phenacyl |
| o-$HOC_6H_4CH_2$— | salicyl |
| o-$HOC_6H_4CH$= | salicylidine |
| o-$HOC_6H_4CO$— | salicyloyl |
| $CH_3OC_6H_4CH_2$— | anisyl (o-, m-, p-) |
| $CH_3OC_6H_4CO$— | anisoyl (o-, m-, p-) |
| Sulfur-containing functional groups | |
| HS— | mercapto |
| —S— | thio |
| $CH_3S$— | methylthio |
| $C_2H_5S$— | ethylthio |
| $C_6H_5S$— | phenylthio |
| S= | thioxo |
| —CS—, >CS | thiocarbonyl |
| —CHS | thioformyl |
| $CH_3CS$— | thioacetyl |
| —COSH, —CSOH | thiocarboxy |
| —CSSH | dithiocarboxy |
| $H_2N$—CS— | thiocarbamoyl |
| —$SO_2H$ | sulfino |
| —$SO_3H$ | sulfo |
| —SO— | sulfinyl |
| —$SO_2$— | sulfonyl |
| $CH_3SO_2$— | mesyl |
| $C_6H_5SO_2$— | benzenesulfonyl or phenylsulfonyl |
| $CH_3C_6H_4SO_2$— | toluenesulfonyl(o-, m-) or tolylsulfonyl(o-, m-) |
| p-$CH_3C_6H_4SO_2$— | tosyl |
| $H_2N$—$SO_2$— | sulfamoyl |
| $HO_3S$—NH— | sulfoamino |
| $H_2N$— | amino |
| $CH_3NH$— | methylamino |
| $(CH_3)_2N$— | dimethylamino |
| $C_6H_5NH$— | anilino |
| $CH_3C_6H_4NH$— | toluidino(o-, m-, p-) |
| $(CH_3)_2C_6H_3NH$— | xylidino(1,2-; 1,3- etc.) |
| —NH—, =NH | imino |
| $C_6H_5N$= | phenylimino |
| N=, —N< | nitrilo |
| —CN | cyano |
| —N=C | isocyano |
| —OCN | cyanato |
| —NCO | isocyanato |
| —SCN | thiocyanato |
| —NCS | isothiocyanato |

-continued

| | |
|---|---|
| —NHOH | hydroxyamino |
| =N—OH | hydroxyimino |
| $CH_3CONH$— | acetamido or acetylamino |
| $C_6H_5CONH$— | benzamido or benzoylamino |
| 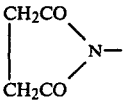 | succinimido |
| $H_2N$—CO— | carbamoyl |
| —NO | nitroso |
| —$NO_2$ | nitro |
| 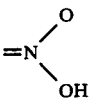 | aci-nitro |
| 2,4,6-$(NO_2)_3C_6H_2$— | picryl |

Functional groups containing 2 or more nitrogen atoms

| | |
|---|---|
| $H_2N$—NH— | hydrazino |
| $H_2N$—N= | hydrazono |
| —NH—NH— | hydrazo |
| —N=N— | azo |
| $C_6H_5$-N=N— | phenylazo |
| $C_{10}H_7$-N=N— | naphthylazo(1-, 2-) |
| 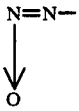 | azoxy |
| $N_2$= | diazo |
| $N_3$— | azido |
| —N=N—NH | diazoamino |
| $NH_2CONH$— | ureido |
| —NHCONH— | ureylene |
| $H_2N$—C(=NH)— | amidino |
| $H_2N$—C(=NH)—NH— | guanidino |

Aliphatic hydrocarbon groups

| | |
|---|---|
| $CH_3$— | methyl |
| $CH_3CH_2$— | ethyl |
| $CH_3CH_2CH_2$— | propyl |
| $(CH_3)_2CH$— | isopropyl* |
| $CH_3CH_2CH_2CH_2$— | butyl |
| $(CH_3)_2CHCH_2$— | isobutyl* |
| $CH_3CH_2CH(CH_3)$— | sec-butyl* |
| $(CH_3)_3C$— | tert-butyl* |
| $CH_3CH_2CH_2CH_2CH_2$— | pentyl |
| $(CH_3)_2CHCH_2CH_2$— | isopentyl* |
| $(CH_3)_3OCH_2$— | neopentyl* |
| $CH_3(CH_2)_5$— | hexyl |
| $CH_3(CH_2)_6$— | heptyl |
| $CH_3(CH_2)_7$— | octyl |
| $CH_3(CH_2)_8$— | nonyl |
| $CH_3(CH_2)_9$— | decyl |
| $CH_3(CH_2)_{10}$— | undecyl |
| $CH_3(CH_2)_{11}$— | dodecyl |
| —$CH_2$—, $CH_2$= | methylene |
| —$CH_2CH_2$— | ethylene |
| —$CH_2CH_2CH_2$— | trimethylene |
| —$CH_2CH_2CH_2CH_2$— | tetramethylene |
| —$CH(CH_3)CH_2$— | propylene |
| $CH_3CH$= | ethylidene |
| $CH_3CH_2CH$= | propylidene |
| $(CH_3)_2C$= | isopropylidene |
| HC≡ | methylidyne |
| $CH_3C$≡ | ethylidyne |
| $CH_2$=CH— | vinyl |
| $CH_3CH$=CH— | 1-propenyl |
| $CH_2$=$CHCH_2$— | allyl |

-continued

| | |
|---|---|
| $CH_2$=$C(CH_3)$— | isopropenyl* |
| $CH_3CH_2CH$=CH— | 1-butenyl |
| $CH_3CH$=$CHCH_2$— | 2-butenyl |
| $CH_3CH_2CH$=$CHCH_2$— | 2-pentenyl |
| —CH=CH— | vinylene |
| —$CH_2CH$=CH— | propenylene |
| $CH_2$=C— | vinylidene |
| CH≡C— | ethynyl |

Alicyclic hydrocarbon groups

| | |
|---|---|
| $C_3H_5$— | cyclopropyl |
| $C_5H_9$— | cyclopentyl |
| $C_6H_{11}$— | cyclohexyl |
| 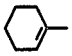 | 1-cyclohexenyl |

Aromatic hydrocarbon groups

| | |
|---|---|
| $C_6H_5$— | phenyl |
| $CH_3C_6H_4$— | tolyl(o-, m-, p-) |
| $(CH_3)_2C_6H_3$— | xylyl(2,3-: 2,4-, etc.) |
| 2,4,6-$(CH_3)_3C_6H_2$— | mesityl |
| $(CH_3)_2CHC_6H_4$— | cumenyl(o-, m-, p-) |
| $C_6H_5CH_2$— | benzyl |
| $C_6H_5CH_2CH_2$— | phenethyl |
| $C_6H_5CH(CH_3)$— | α-methylbenzyl |
| $(C_6H_5)_2CH$— | benzhydryl or diphenylmethyl |
| $(C_6H_5)_3C$— | trityl or triphenylmethyl |
| —$C_6H_4$— | phenylene(o-, m-, p-) |
| $C_6H_5CH$= | benzylidene |
| $C_6H_5CH$=CH— | styryl |
| $C_6H_5CH$=$CHCH_2$— | cinnamyl |
| $C_6H_5CH$=CHCH— | cinnamylidene |
| $C_6H_5$—$C_6H_4$— | biphenylyl(o-, m-, p-) |
| $C_{10}H_7$— | naphthyl(1-, 2-) |
| —$C_{10}H_6$— | naphthylene(1,2-: 1,4- etc.) |
| $C_{14}H_9$— | anthryl(1-, 2-, 5-) |
| $C_{14}H_9$— | phenanthryl(1-, 9-, etc.) |

Oxygen-containing simple functional groups

| | |
|---|---|
| HO— | hydroxy |
| HOO— | hydroperoxy |
| —O— | oxy: in cyclic structure, (epoxy) |
| —OO— | dioxy: in cyclic structure,(epidioxy) |
| O= | oxo |
| —CO— 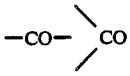 | carbonyl |

Ether groups

| | |
|---|---|
| $CH_3O$— | methoxy |
| $C_2H_5O$— | ethoxy |
| $CH_3CH_2CH_2O$— | propoxy |
| $(CH_3)_2CHO$— | isopropoxy* |
| $CH_3CH_2CH_2CH_2O$— | butoxy |
| $CH_3CH_2CH_2CH_2CH_2O$— | pentyloxy |
| $C_6H_5O$— | phenoxy |
| $C_6H_5CH_2O$— | benzyloxy |
| —$OCH_2O$— | methylenedioxy |
| —$OCH_2CH_2O$— | ethylenedioxy |

Carboxylic acid and ester groups

| | |
|---|---|
| —COOH | carboxy |
| —$COOCH_3$ | methoxycarbonyl |
| —$COOC_2H_5$ | ethoxycarbonyl |
| HCOO— | formyloxy |
| $CH_3COO$— | acetoxy |
| $C_6H_5COO$— | benzoyloxy |
| HCO—, —CHO | formyl |
| $CH_3CO$— | acetyl |
| $CH_3CH_2CO$— | propionyl |
| $CH_3CH_2CH_2CO$— | butyryl |
| $(CH_3)_2CHCO$— | isobutyryl* |
| $CH_3CH_2CH_2CH_2CO$— | valeryl |
| $(CH_3)_2CHCH_2CO$— | isovaleryl* |
| $(CH_3)_3CCO$— | pivaloyl* |
| $CH_3(CH_2)_4CO$— | hexanoyl |
| $CH_3(CH_2)_5CO$— | octanoyl |
| $CH_3(CH_2)_{10}CO$— | lauroyl* (with substituent, dodecanoyl) |
| $CH_3(CH_2)_{14}CO$— | palmitoyl* |

-continued

| | |
|---|---|
| | (with substituent, hexadecanoyl) |
| $CH_3(CH_2)_{16}CO-$ | stearoyl* |
| | (with substituent, octadecanoyl) |
| $C_8H_{17}CH=CH(CH_2)_7CO-$ | oleoyl |
| $CH_2=CHCO-$ | acryloyl |
| $CH_2=C(CH_3)CO-$ | methacryloyl |
| $ClCO-$ | chloroformyl |
| $CH_3COCO-$ | pyruvoyl |
| $HOOC-CO-$ | oxalo |
| $CH_3OOC-CO-$ | methoxyalyl |
| $C_2H_5OOC-CO-$ | ethoxyalyl |
| $-CO-CO-$ | oxalyl |
| $-COCH_2CO-$ | malonyl |
| $-COCH_2CH_2CO-$ | succinyl |
| $-CO(CH_2)_3CO-$ | glutaryl |
| $-CO(CH_2)_4CO-$ | adipoyl |
| $-CO(CH_2)_5CO-$ | suberoyl* |
| | (with substituent, octanedioyl) |
| 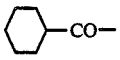 | cyclohexanecarbonyl or cyclohexylcarbonyl |
| $C_6H_5CO-$ | benzoyl |
| $CH_3C_6H_4CO-$ | toluoyl(o-, m-, p-) |
| $C_6H_5CH=CHCO-$ | cinnamoyl |
| $C_{10}H_7CO-$ | naphthoyl(1-, 2-) |
| $-CO-C_6H_4-CO-$(o-) | phthaloyl |
| $-CO-C_6H_4-CO-$(m-) | isophthaloyl |
| $-CO-C_6H_4-CO-$(p-) | terephthaloyl |

The second mode of the nitrogen-containing compound contained in the developer of the present invention takes the form of a silane coupling agent represented by the formula shown below, with which fine silica powders are coated:

$$R_mSiY_n$$

wherein R is an alkoxy group or a chlorine atom, m is an integer of 1 to 3, Y is an unsaturated nitrogen-containing heterocyclic group or its derivative and n is an integer of 3 to 1.

As the unsaturated nitrogen-containing heterocyclic ring, a large number of rings have been known in the art and typical examples are set forth below:

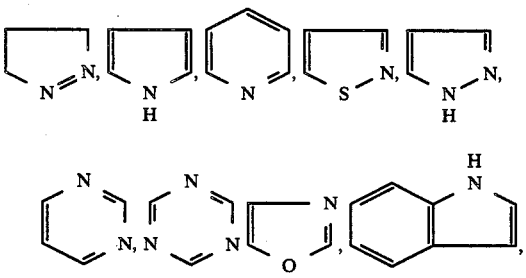

-continued

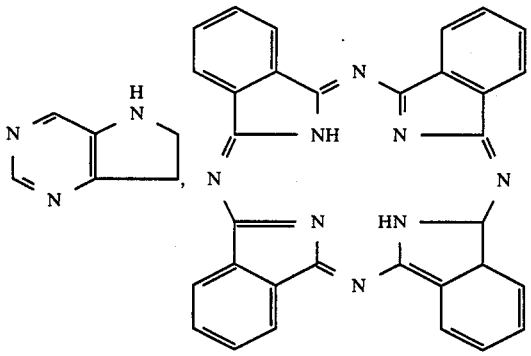

As their derivatives, they can be converted into all derivatives known in the art having groups such as vinyl group, mercapto group, methacrylic group, glycidoxy group, ureido group, etc., provided that these groups should not interfere with charge controlling characteristics of hydrocarbon groups, halo groups and amino groups, and these groups may be introduced into any of thereplaceable sites of the above compounds.

The fine silica particles to be treated with the above silane coupling agent may preferably so called "fumed silica" or "dry process silica", which is prepared by vapor phase oxidation of a silicon halide. The technique of vapor phase oxidation is known per se. For example, fumed silica can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl$$

In the above preparation step, it is also possible to obtain complex fine powders of silica and other metal oxides by using other metal halide compounds such as aluminum chloride or titanium chloride together with silicon halide compounds. They are also included in the fine silica particles of the present invention. It is preferred to use fine silica particles, of which mean primary particle size is desirably within the range from 0.001 to 2 $\mu$, particularly preferably from 0.002 to 0.2$\mu$.

Commercially available fine silica powder formed by vapor phase oxidation of a silicon halide to be used in the present invention include those sold under the trade name as shown below.

| | |
|---|---|
| AEROSIL | 130 |
| (Nippon Aerosil Co.) | 200 |
| | 300 |
| | 380 |
| | TT 600 |
| | MOX 80 |
| | MOX 170 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |

-continued (Fransil Co.)

Examples of adding fine silica powder formed by vapor phase oxidation of a silicon halide to a developer for electrophotography are known in the art. However, even a developer containing a dye having positive charge controlling characteristic is changed thereby to negative in its charging polarity and therefore unsuitable for visualization of negative electrostatic images. The present inventors have studied about the above-mentioned phenomenon and consequently found that the fine silica powder formed by vapor phase oxidation of a silicon halide of the prior art reduces the charges of a positively chargeable developer or reverses its polarity. Further, as the result of detailed investigations made in order to obtain a developer exhibiting positive chargeability with stable and high triboelectric charges and also having uniform positive chargeability, it has been found effective to incorporate in a developer the fine silica particles formed according to vapor phase oxidation of a silicon halide treated with the silane coupling agent of the formula as described above, namely:

$$R_mSiY_n$$

wherein R is an alkoxy group or a chlorine atom, m is an integer of 1 to 3, Y is an unsaturated nitrogen-containing heterocyclic group or its derivative and n is an integer of 3 to 1.

The amount of the silane coupling agent applied on the fine silica particles should preferably be 0.1 to 30 wt. %, more preferably 0.5 to 20 wt. %. Also, the fine silica particles, which have nitrogen-containing unsaturated heterocyclic ring have excellent effect for hydrophobic modification. For effecting further hydrophobic modification, however, after treatment with the above-mentioned silane coupling agent or simultaneously with the silane coupling agent, they can be treated with an organic silicon compound. Examples of such organic silicon compounds may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans, such as trimethylsilylmercaptan, triorganosilyl acrylates, such as vinyldimethylacetoxysilane, and further dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units; and the like. These may be used alone or as a mixture of two or more compounds. The preferable weight ratio of the silane coupling agent and the treating agent for hydrophobicity modification is within the range of 15:85 to 85:15, and the value of the triboelectric charging quantity of the developer containing the fine silica powder can be controlled to a desired value by varying the ratio within said range, and the ratio can be chosen as desired. It will also depend on the kinds of the silane coupling agent and the treating agent for hydrophobicity modification employed. The total quantity of the silane coupling agent and the treating agent for hydrophobicity modification may preferably be 0.1 to 30 wt. %, more preferably 0.5 to 20 wt. %, based on the fine silica particles.

The above nitrogen-containing compound may be included in a developer either by incorporating it internally within the toner particles or adding it externally to the toner particles.

In the case of internal incorporation of the A-B conjugate, the amount of the controller may desirably be 0.5 to 50 parts by weight per 100 parts by weight of the resin. In the case of external addition, it is desirably 0.01 to 40 parts by weight per 100 parts by weight of the resin.

The amount of the nitrogen-containing silane coupling agent $R_mSiY_n$ to be applied on fine silica particles may be 0.01 to 20% by weight in terms of the ratio of the total amount of the nitrogen-containing silane coupling agent, the fine silica particles and, optionally, the treating agent for hydrophobic modification with respect to the amount of the developer to exhibit its effect, particularly preferably in an amount of 0.1 to 3% to exhibit positive chargeability having excellent stability. In an especially preferable mode of addition, 0.01 to 3% by weight of treated fine silica particles are attached on the toner particle surfaces.

The binder resin for the toner of the present invention may be composed of homopolymers of styrene and derivatives thereof such as polystyrene, poly-p-chlorostyrene, polyvinyltoluene, and the like; styrene copolymers such as styrene-propylene copolymer, styrenevinyltoluene copolymer, styrene vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-isoprene copolymer, styrene-acrylonitrile-indene copolymer, styrene-maleic acid copolymer styrene-maleic acid ester copolymer, and the like; polymethyl methacrylate, polyburyl methacrylate, polyvinyl chloride, polyvinyl acetate, polyethylene, polypropylene, polyesters, polyurethanes, polyamides, epoxy resins, polyvinyl butyral, polyamide, polyacrylic acid resin, rosin, modified rosins, terpene resin, phenol resins, aliphatic or alicyclic hydrocarbon resins, aromatic petroleum resin, chlorinated paraffin, paraffin wax, etc. These binder resins may be used either singly or as a mixture.

It is also possible to use positive charge controlling agents known in the art in combination with the treated fine silica powder to be used in the present invention. For example, various dyes such as benzyldimethylhexadecylammonium chloride, decyltrimethylammonium chloride, nigrosine base, nigrosine hydrochloride, safranine γ and crystal violet may be used.

In the toner of the present invention, any suitable pigment of dye may be available as the colorant. For example, there may be included known dyes and pigments such as carbon black, iron black, phthalocyanine blue, ultramarine blue, quinacridone, benzidine yellow, etc. It is also possible to add flow agents such as silica, alumina and the like.

In order to use the toner of the present invention in the form of a magnetic toner, magnetic powders may also be incorporated therein. As such magnetic powder, there may be employed a material which is magnetized when placed in a magnetic field, including powder of a strongly magnetic metal such as iron, cobalt or nickel, or alloys thereof, or compounds such as magnetite, hematite, or ferrite. The magnetic powder may be contained in an amount of 15 to 70 wt. % based on the weight of the toner. The toner constitution as described above can be carried on the wall material, core material or both in a microcapsule toner.

Further, the toner of the present invention can be mixed with carrier particles, if desired, such as iron powder, glass beads, nickel powder, ferrite powder, etc. to be used as a developer for electrostatic latent images. The developer of the present invention is applicable to various developing methods. For example, it is applicable to the magnetic brush developing method, the cascade developing method, the method as disclosed in U.S. Pat. No. 3,909,258 in which conductive magnetic toner is used, the method as disclosed in Japanese Laid-Open Patent Application No. 31136/1978 in which high resistivity magnetic toner is used, the methods as disclosed in Japanese Laid-Open Patent Application Nos. 42121/1979, 18656/1980 and 43027/1979, the fur brush developing method, the powder cloud method, the impression developing method, and others.

However, by utilizing fully the stable triboelectric charging characteristic of the nitrogen-containing developer of the present invention, it is particularly suitable to apply the developer for the developing method of the present invention using a developer carrying member such as a sleeve. The developing method of the present invention is practically applied in embodiments as shown in FIG. 1 through FIG. 5 when the developer is non-magnetic, while in an embodiment as shown in FIG. 6, when the developer is magnetic.

In FIG. 1, 1 is a cylindrical electrostatic image bearing member, 2 is a toner carrying member, 3 is a hopper which is a toner feeding means, 4 is a coating means and 5 is an insulating non-magnetic toner as specified in the present invention.

For example, an electrostatic image is formed on the electrostatic image bearing member 1 according to the Carlson process or the NP process known in the art and developed with the toner 5 which has been applied as a coating on the toner carrying member 2 in a regulated layer thickness with the coating means, which applies the insulating non-magnetic toner 5 within the hopper 3. The toner carrying member 2 is a developing roller comprising a cylindrical stainless steel. Aluminum or other metals may also be available as a material for this developing roller. It is also possible to use a metal roller coated with a resin in order to effect triboelectric charging of the toner on the roller to a more desirable polarity. Further, this developer may be made of an electroconductive non-metallic material. Although not shown in the Figure, spacer rollers are placed in the shaft at the both ends of the toner carrying member 2. By pushing the spacer rollers against the both ends of the electrostatic bearing member 1 to fix the developing instrument, the gap between the electrostatic image bearing member 1 and the toner carrying member is set and maintained thicker than the thickness of the toner layer. This gap may be, for example, 100μ to 500μ, preferably 150μ to 300μ. If this gap is too large, the electrostatic force from the electrostatic latent image on the electrostatic bearing member acting on the non-magnetic toner coated on the toner carrying member will be weakened to lower the image quality. In particular, visualization of fine lines by development is rendered difficult. On the contrary, if this gap is too narrow, the risk of agglomeration of the toner coated on the toner carrying member 2 through compression between the toner carrying member 2 and the electrostatic image bearing member 1 will become great. A development bias power source 6 is arranged so as to apply a voltage between the electroconductive toner carrying member 2 and the back electrode of the electrostatic image bearing member 1. This development bias voltage is a development bias voltage as disclosed in U.S. Pat. No. 4,292,387.

Figure 2:
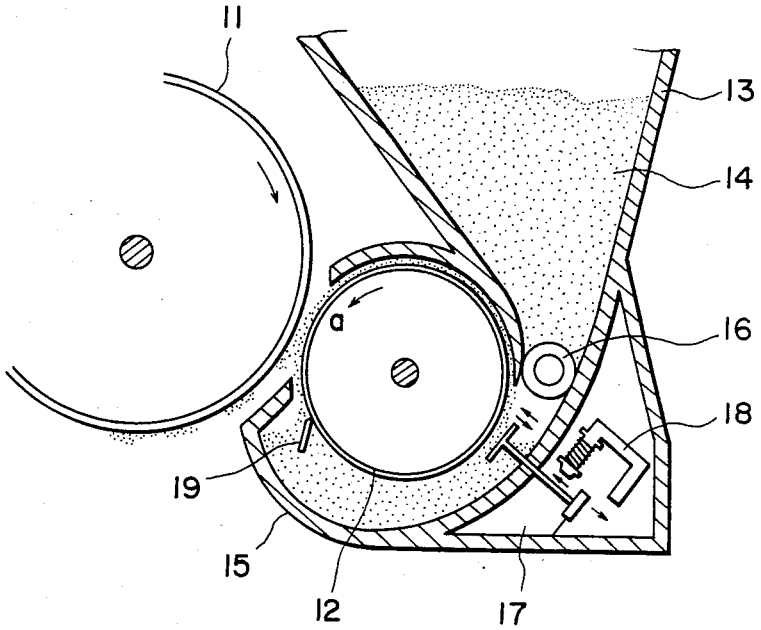

FIG. 2 shows another example of the developing device. In this Figure, 11 is an electrostatic image bearing member, 12 is a toner carrying member, 13 is a hopper, 14 is an insulating non-magnetic toner as specified by the present invention, 15 is a toner storage part and 16 is a toner feeding member. In order to give vibration to the toner 14 in the storage part 15, a vibrating member 17 and a vibration generating means 18 are provided under the hopper 13. Reference numeral 19 denotes a cleaning blade. In this developing device, the vibrating member is vibrated at an appropriate amplitude and frequency by means of the vibration generating means 18, thereby forming a uniform toner coating layer on the toner carrying member rotating at a constant speed, while putting the toner carrying member 12 and the electrostatic image bearing member face to face with a gap greater than the thickness of the toner coating layer, and development is effected by permitting the non-magnetic toner to jump toward the electrostatic image. The degree of vibration of the vibrating member 17 is not particularly limited, provided that it does not directly contact the toner carrying member 12, but it is preferred to control frequency and amplitude so that the thickness of the toner may be uniformly about 5 to 100μ. It is also possible to apply a bias voltage of alternate or/and direct current between the toner carrying member 12 and the electrostatic image bearing member 11.

Figure 3:
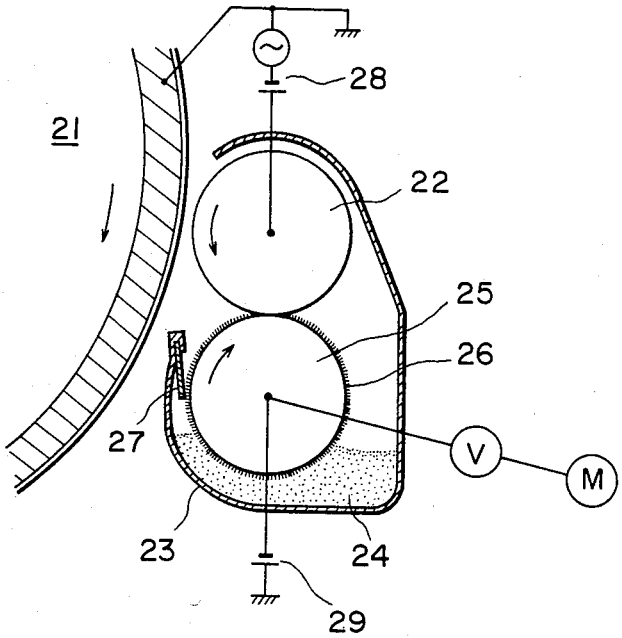

FIG. 3 shows still another example of developing device. In this Figure, 21 is an electrostatic image bearing member, 22 is a toner carrying member, 23 is a toner supplementing part, 24 is an insulating non-magnetic toner as specified by the present invention, 25 is a coating roller, 26 is a fiber brush secured on the surface of the coating roller, 27 is a toner cleaning member, 28 is a developing bias power source, and 29 is a bias power source for coating. The coating roller 25 contacts the toner carrying member 22 and rotates at the contacted portion in the same direction as the toner carrying member 22. The coating roller 25 rotates and conveys the toner 24 with its brush 26 and applies the toner evenly on the toner carrying member 22, the toner then being permitted to jumps toward the electrostatic image on the electrostatic image bearing member 21 to effect development. The gap between the toner carrying member and the coating roller 25 is adjusted so as to form an even toner layer of about 5 to 100μ on the toner carrying member 22. For even toner coating, a bias voltage may be applied from the bias power source 29. The gap between the electrostatic image bearing member 21 and the toner carrying member 22 is adjusted to be greater than the toner layer thickness, and developing bias may be applied from the bias power source 28 during development.

Figure 4:
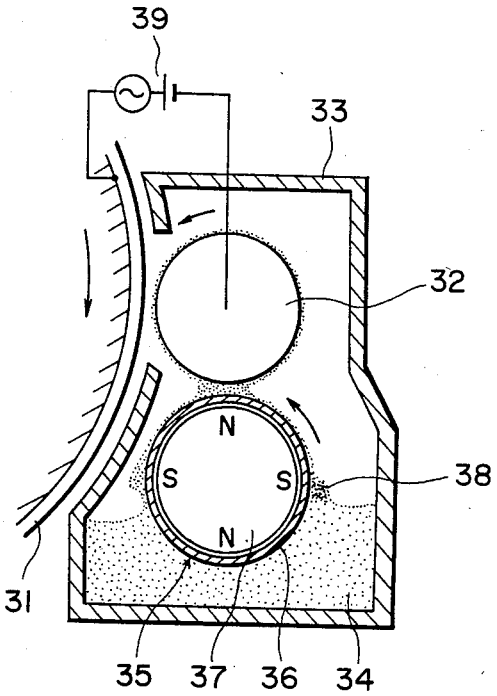

FIG. 4 shows still another example of the developing device. In this Figure, 31 is an electrostatic bearing member, 32 is a toner carrying member, 33 is the main body of the developing device, 34 is an insulating one-component non-magnetic toner and 35 is a magnetic roller. The magnetic roller 35 is constituted of a non-magnetic sleeve 36 and a magnet 37 provided within the sleeve to form a magnetic brush 38 thereon. In this developing device, magnetic carrier particles are held through magnetic force on the non-magnetic sleeve 36 to form a brush and the toner 34 is drawn up with the carrier brush to be applied by contact on the toner carrying member 32, thereby forming an even toner layer thereon. During this operation, since the carrier particles are held on the magnetic roller 35, they will not be transferred onto the toner carrying member. Then, the toner is permitted to fly from the toner carrying member 32 toward the electrostatic image bearing member 31. The gap between the magnetic roller 35 and the toner carrying member 32 is adjusted so that the toner layer thickness layer may be about 5 to 100μ. The gap between the toner carrying member and the electrostatic image bearing member is adjusted greater than the toner layer thickness, and a bias voltage may be applied from the developing bias power source 39, if necessary.

Figure 5:
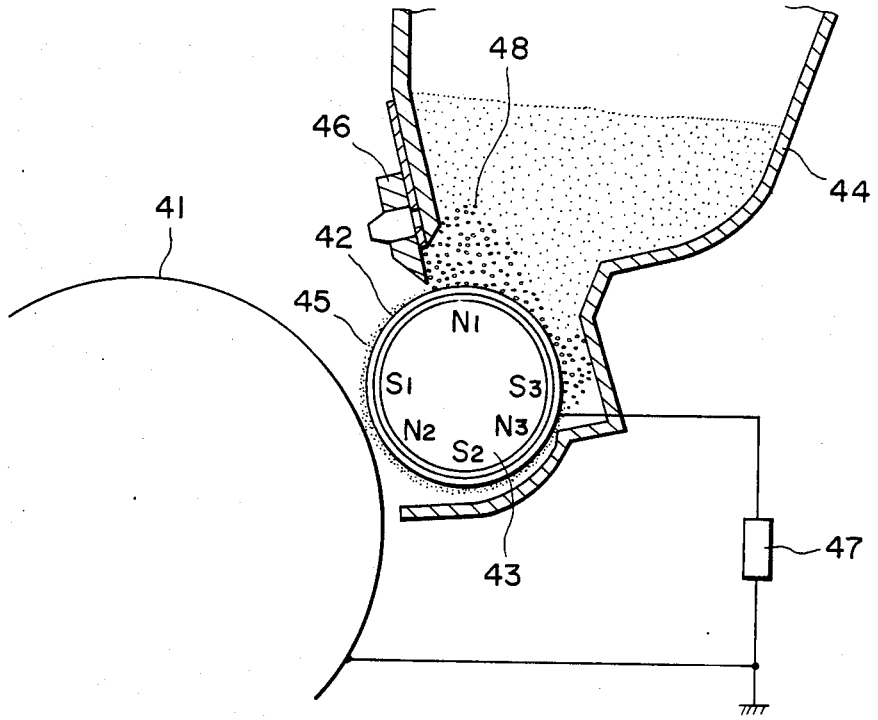
Figure 6:
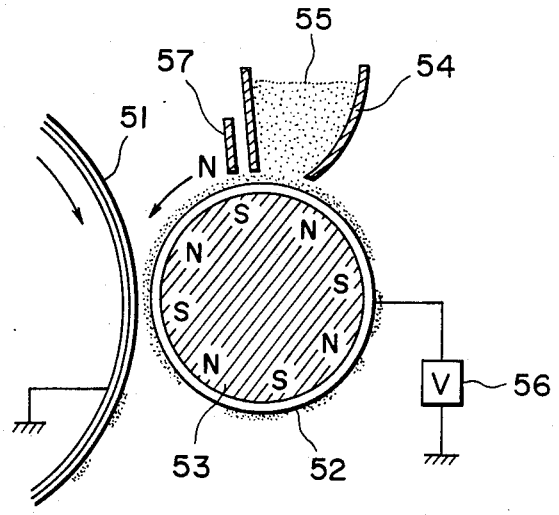
FIG. 6 shows a device for practicing the developing method of the invention by use of a magnetic developer.

FIG. 5 shows still another example of developing device. In this Figure, 41 is an electrostatic image bearing member, 42 is a toner carrying member in the shape of a sleeve, 43 is a fixed magnet arranged within the toner carrying member 42, 44 is a hopper, 45 is a one-component non-magnetic toner as specified by the present invention, 46 is a toner thickness regulating blade, and 47 is a bias power source for development. In this developing device, a magnetic brush 48 of carrier-toner mixture is formed on the toner carrying member 42, and by rotating the toner carrying member 42, the magnetic brush 48 is circulated to take in the toner within the hopper, which toner is then subjected to coating evenly in thin layer on the toner carrying member 42.

Subsequently, with the toner carrying member 42 and the electrostatic image bearing member 41 facing each other with a gap greater than the toner layer thickness, the one-component non-magnetic toner on the toner carrying member 42 is permitted to jump onto the electrostatic image on the electrostatic image bearing member 41 to effect development thereon.

The thickness of the toner layer is controlled by the size of the magnetic brush 48, namely the amount of carrier and the regulating blade 46. The gap between the electrostatic bearing member 41 and the toner bearing member 42 is set greater than the toner layer thickness. In this case, a developing bias voltage may be applied from the bias power source 47.

The developing method of the present invention using a magnetic developer may be practiced according to, for example, a device as shown in FIG. 6. In this Figure, the electrostatic image bearing member 51 rotates in the direction of the arrow. The nonmagnetic cylinder 52 which functions as a developer carrier rotates so as to progress in the same direction as the surface of the electrostatic bearing member in the developing section. Within the non-magnetic cylinder 52, a multi-pole permanent magnet 53 is arranged so that it may not rotate. The one-component insulating magnetic developer 55 delivered from the developer vessel 54 is applied on the surface of the non-magnetic cylinder 52 and the toner particles are charged to the opposite polarity to thereof the electrostatic image charges through friction of the cylinder surface with the toner particles. Further, by arrangement of a doctor blade 56 made of iron in close vicinity of the cylinder surface (with a gap of 50μto 500μ) as confronted to one pole (S pole in the Figure) of the multiple-pole permanent magnet 53, the thickness of the toner is regulated thin (30μ to 300μ) and evenly. By controlling the rotational speed of this cylinder 52, the surface layer speed of the developer layer and preferably the internal speed is controlled substantially equal to or approximate to the speed of the electrostatic image bearing surface. As the doctor blade 57, a counter-pole may be formed with the use of a permanent magnet in place of iron. Also, in the developing section, an alternate bias voltage may be applied from the power source 56 between the developer carrying member and the electrostatic image bearing surface. This alternate bias voltage may have a frequency of 200 to 4000 Hz and a Vpp of 500 to 3000 V.

As described above, in the developing step, in order to hold one-component magnetic developer stably, a non-magnetic cylinder 52 including a multi-pole permanent magnet 53 was employed. Also, for the purpose of forming a thin and even developer layer, a doctor blade 57 of a magnetic thin plate or a permanent magnet was arranged in close vicinity of the surface of the cylinder 52. When a doctor blade of a magnetic material is used in this way, a counter-pole is formed between the blade and a pole of the permanent magnet enclosed within the developer carrying member, whereby the toner particles chain is forcibly erected between the doctor blade and the developer carrying member. Thus, the developer can be advantageously regulated at the other positions on the developer carrying member, for example at the developing position facing the electrostatic image surface. Further, by giving such a forcible movement to the developer, the developer layer can be made more even to achieve formation of a thin and even toner layer. Moreover, since the distance between the doctor blade and the sleeve can be set somewhat broader, there is attained an effect of preventing destruction or agglomeration of toner particles. During transfer of the toner at the developing position, the toner is transferred through the attracting action of the electrostatic image or the action of alternate current bias to the side of electrostatic image.

The first characteristic of the developing method employing the positively chargeable developer thus constituted resides in that the amount of triboelectric charges between the toner particles or between the toner and the toner carrying member such as sleeve is stable and can be controlled to a quantity of charges suitable for the developing system to be employed. Accordingly, there is no development of fog or scattering of the toner around the edges of the latent image which has not been sufficiently solved in the prior art, and a high image density can be obtained with improved reproducibility of half tone.

Further, when the developer is subjected to continuous use over a long term, the characteristics at the initial stage can be maintained and images of high quality can be produced for a long term.

Further, there are several important characteristics in practical application. One of them is that the amount of triboelectric charge on the developer during use under the environmental conditions of higher temperature and humidity is stable and not substantially different from that under normal temperature and humidity, and therefore development can be carried out faithfully to the latent image without fog or lowering in image density, and further with excellent transfer efficiency.

Also even when used under lower temperature and humidity conditions, the distribution of triboelectric charges does not substantially change, without formation of a developer component with extremely great quantity of charge, and therefore, to be surprising enough, there is neither lowering in image density nor occurrence of fog, substantially without coarsening or scattering of the toner during transfer.

Having described above about the basic features and characteristics of the present invention, description is now made in detail below based on the Examples. However, the embodiments of the present invention are not limited by these Examples. Parts in Examples are parts by weight.

EXAMPLE 1A

| | |
|---|---|
| Styrene-n-butyl methacrylate copolymer | 100 parts |
| Copper phthalocyanine | 10 parts |
| Nigrosine | 2 parts |

The above materials were well blended in a blender and then kneaded on twin rolls heated to 150° C. The kneaded product was left to cool, coarsely crushed by a cutter mill, pulverized by means of a micropulverizer with a jet air stream and further subjected to classification by use of a wind force classifier to obtain fine powder of 5 to 20μ.

As the next step, fine silica particles Aerosil 200 (produced by Nippon Aerosil K.K.) were placed in a sealed type Henschel mixer heated to 70° C. and stirred at a high speed, while adding to the silica dropwise N-(trimethoxysilylpropyl)imidazole of the formula shown below diluted with alcohol to a quantity of 3.0% of the silane coupling agent based on silica.

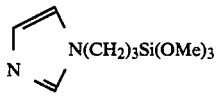

The fine particles obtained were dried at 120° C.

To 5 parts of a mixture of the above fine powder and 0.8% of the treated fine silica particles 100 parts of iron powder carrier with particle sizes of 50 to 80μwere added and mixed by a Henschel mixer to prepare a developer.

Then, according to the electrophotographic method of the prior art, negative electrostatic images were formed on an OPC photosensitive member as explained in Example 1B appearing hereinafter and subjected to powder development according to the magnetic brush method with the use of the above developer to form toner images, which were in turn transferred onto plain papers and fixed by heating. The transferred images obtained were found to be good with high resolution, having sufficiently high densities up to 1.30, without fog at all, being also free from scattering of the toner around the images. Transferred images were formed continuously by use of the above developer for examination of its performance under successive copying operations to give the result that the transferred image after copying 20000 sheets was found to be totally comparable to the images at the initial stage.

When the environmental conditions were changed to 35° C. and 85% R.H., the image density was 1.26, which was a value substantially unchanged from that under normal temperature and normal humidity conditions, and clear images could be obtained without fog and scattering of the toner, indicating substantially the same performances up to 30000 sheets of copying. Then, when transferred images were obtained at a low temperature and a low humidity of 10° C. and 10%, the image densities were found to be high up to 1.48, and the solid black portions could be developed and transferred very smoothly to give excellent images without scattering or drop-off of the toner. When successive copying was conducted under these environmental conditions, both continuously and intermittently, the density fluctuation was within ±0.2 up to 30000 sheets of copying, thus showing that the developer was satisfactory in practical applications.

COMPARATIVE EXAMPLE 1A

A developer was prepared in the same manner as in Example 1A, except that Aerosil 200 was not treated with the silane coupling agent, and development and transfer were also conducted similarly. As the result, only reversed images could be obtained to exhibit negative charging characteristic.

EXAMPLE 2A

Example 1A was repeated except that (trimethoxysilyl)-guanamine:

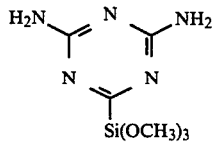

was employed as the silane coupling agent. The results obtained were good similarly as in Example 1A.

EXAMPLE 3A

Example 1A was repeated except that phthalocyanatodichlorosilane:

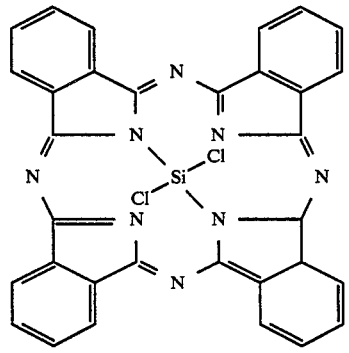

was employed as the silane coupling agent. The results obtained were good similarly as in Example 1A.

EXAMPLE 4A

The treated fine silica particles obtained in Example 1A were placed in a Henschel mixer again, and dimethyldichlorosilane was sprayed onto the silica under stirring to an amount of 2.0% by weight. The mixture was subjected to a high speed stirring at room temperature for 2 hours, further stirred at 80° C. for 24 hours, and the mixer was opened to atmospheric pressure. The mixture was further dried by stirring at a low speed at 60° C. for 5 hours.

The fine treated silica particles obtained were mixed with the fine toner powder similarly as in Example 1. The results obtained were found to be good. Particularly, even under the environment of 35° C. and 85% RH, the reflection image density was not lowered at all.

EXAMPLE 1B

| | |
|---|---|
| Styrene-2-ethylhexyl acrylate copolymer | 100 parts |
| Phthalocyanine blue | 5 parts |
| Nigrosine | 2 parts |

Using the above materials, fine powdery toner starting material with particle sizes of 5 to 20μ was obtained in the same manner as in Example 1A and further mixed with the same treated silica particles in a Henschel mixer to obtain a toner.

On the other hand, a mixture comprising 100 parts by weight of zinc oxide, 20 parts by weight of a styrene-butadiene copolymer, 40 parts by weight of n-butyl methacrylate, 120 parts by weight of toluene and 4 parts by weight of 1% methanolic solution of Rose Bengal was dispersed and mixed in a ball mill for 6 hours. The resultant mixture was applied with a wire bar on an aluminum plate with a thickness of 0.05 mm to a thickness of coating after drying of 40μ, followed by evaporation of the solvent to prepare a zinc oxide binder type photosensitive member, which was then formed into a drum. After the photosensitive member was subjected to corona discharging at ⊖6 KV to be charged uniformly over the whole surface, followed by irradiation of the original image to form an electrostatic latent image. The above toner was placed in a developing device as shown in FIG. 1 and the electrostatic latent image on the electrostatic image bearing member comprising the photosensitive member as described above was developed.

The toner carrying member used here was made of a stainless steel cylindrical sleeve of 50 mm in outer diameter, the distance between the surface of the above photosensitive drum and the sleeve surface set at 0.25 mm, and alternate current of 400 Hz at 1000 V and direct current bias of ⊖150 V were applied on the sleeve.

Subsequently, the powder image was transferred while irradiating direct current of corona of ⊖7 KV on the backside of transfer paper to obtain a copied image. Fixing was performed by means of a commercially available plain paper copying machine (trade name: NP-5000, produced by Canon K.K.).

The transferred image obtained had a sufficiently high density, without fog at all, being also free from scattering of the toner around the images, to give a good image with high resolution. Transferred images were formed continuously by use of the above developer for examination of its performance under successive copying operations to give the result that the transferred image after copying 10000 sheets was found to be totally comparable to the images at the initial stage.

When the environmental conditions were changed to 35° C. and 85% R.H., the image density was substantially unchanged from that at normal temperature and normal humidity, and clear blue images could be obtained without substantial change up to 10000 sheets of copying. Then, when transferred images were obtained at a low temperature and a low humidity of 10° C. and 10%, the image densities were found to be high, and the solid black portions could be developed and transferred very smoothly to give excellent images without scattering or drop-off of the toner. When successive copying was conducted under these environmental conditions, both continuously and intermittently, the density fluctuation was within ±0.2 up to 10000 sheets of copying, thus showing that the developer was satisfactory in practical applications.

COMPARATIVE EXAMPLE 1B

With the use of the same materials and the same treatment as in Example 1B, the fine powdery toner starting material was prepared.

The fine silica particles prepared in the same manner as in Example 1B except that the fine silica particles Aerosil 200 were not treated with the silane coupling agent were mixed with the above fine powdery toner starting material to provide a toner.

This toner was placed in a developing device as shown in FIG. 1, and development and transfer were conducted according to entirely the same procedure as in Example 1B. As the result, only reversed images could be obtained, exhibiting negative charging characteristic.

EXAMPLE 2B

With the use of a toner prepared in the same manner as in Example 1 except for using as the silane coupling agent N-(trimethoxysilylethyl)carbazole:

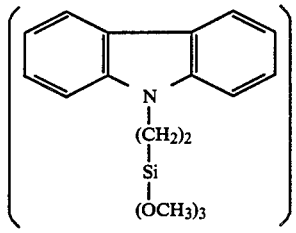

development and transfer were conducted in a developing device as shown in FIG. 1 according to entirely the same procedure as in Example 1B.

Substantially the same results as in Example 1B were obtained.

EXAMPLE 3B

With the use of a toner prepared in the same manner as in Example 1 except for using as the silane coupling agent (trimethoxysilyl)guanamine:

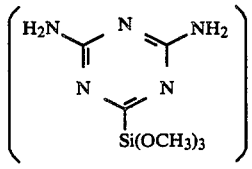

development and transfer were conducted according to entirely the same procedure as in Example 1B.

Good results substantially the same as in Example 1B were obtained.

EXAMPLE 4B

By using the same toner as in Example 1B, an electrostatic latent image on the electrostatic image bearing member 11 was developed by means of a developing device shown in FIG. 2. During the operation, the vibrating member 17 was vibrated at a frequency of about 50 Hz and an amplitude of 0.2 mm, and the toner carrying member 12 was rotated at a circumferential speed of 120 mm/sec. As the result, a uniformly coated toner layer was formed to a thickness of about 50μ on the toner carrying member. Development was performed by placing the toner carrying member 12 facing the electrostatic image bearing member with a gap of about 300μ therebetween and applying on the toner carrying member a bias alternate current electric field of 100 to several KHz with a minus peak value of −660 to −1200 V and a plus peak value of +400 to +800 V.

Good results substantially the same as in Example 1B could be obtained.

COMPARATIVE EXAMPLE 2B

Using the same toner as in Comparative Example 1, development and transfer were conducted by means of a developing device as shown in FIG. 2 similarly as in Example 4B.

In this case, the drawbacks as explained in Comparative Example 1B were conspicuously observed.

EXAMPLE 5B

Using the same toner as in Example 2B, an electrostatic latent image on the electrostatic image bearing member 21 was developed by means of a developing device as shown in FIG. 3. During the operation, the gap between the toner carrying member 22 and the coating roller 25 was set at about 2 mm and the length of the fiber brush 26 at about 3 mm. By maintaining the gap between the toner carrying member, namely the developing roller 22, and the electrostatic image bearing member 21 at 300μ, a toner layer of about 80μ was formed on the developing roller 22. Development was carried out by applying an alternate current with a wave form of 200 Hz of frequency, and peak values of voltage of ±450 V, with addition of a direct current component of 250 V, thus giving peak voltage values of +700 V and −200 V. As the result, good results were obtained similarly as in Example 1B.

EXAMPLE 6B

Using the same toner as in Example 3B, an electrostatic latent image on the electrostatic image bearing member 31 was developed by means of a developing device as shown in FIG. 4. During the operation, the gap between the toner carrying member 32 and the magnetic roller 35 was set at about 2 mm and the maximum thickness of the magnetic brush 38 at about 3 mm. By maintaining the gap between the toner carrying member, namely the developing roller 32, and the electrostatic image bearing member 31 at 300μ, a toner layer of about 80μ was formed on the developing roller 32. Development was carried out by applying an alternate current with a wave form of 200 Hz of frequency, and peak values of voltage of ±450 V, with addition of a direct current component of 250 V, thus giving peak values of voltage +700 V and −200 V. As the result, good results were obtained similarly as in Example 1B.

EXAMPLE 7B

Twenty (20) grams of the toner of Example 1B were mixed previously with 20 g of iron powder carrier, and the resultant mixture was charged into a developing device as shown in FIG. 5. The clearance between the toner thickness regulating blade 46 and the toner carrying member 42 was set at about 250μ. By maintaining the gap between the toner carrying member, namely the developing roller 42, and the electrostatic image bearing member 41 at 300μ, a toner layer of about 80μ was formed on the developing roller 42. Development was carried out by applying an alternating current with a wave form of 200 Hz frequency, and peak values of ±450 V, with addition of a direct current component of 250 V, thus giving peak values of voltage +700 V and −200 V. As the result, good results were obtained similarly as in Example 1B.

EXAMPLE 1C

Sulfonyl chloride groups were introduced into copper phthalocyanine with chlorosulfonic acid and the compound obtained was then allowed to react with aminophenylguanamine to prepare a compound (1) as shown below.

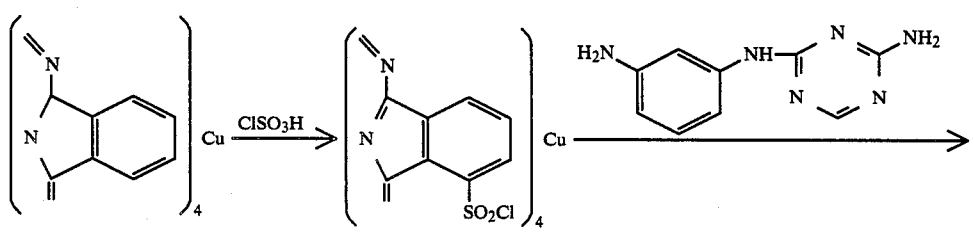

(1)

-continued

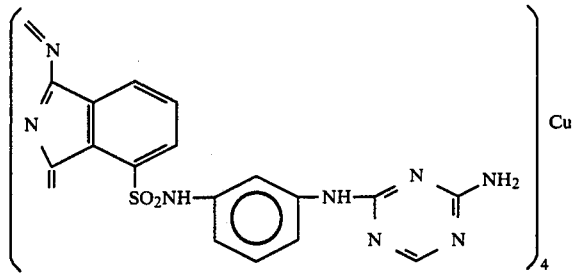

(2)

With the use of the above compound (1), a toner with an average particle size of 10 μm was prepared by mixing and kneading the following formulation with heated rollers, followed by jet pulverization and classification.

| | |
|---|---|
| Styrene-2-ethylhexyl acrylate copolymer | 100 parts |
| Compound (1) | 5 parts |

The above toner was placed in a developing device as shown in FIG. 1, and a negative electrostatic latent image on an electrostatic bearing member obtained similarly as in Example 1B was developed similarly as in Example 1B.

The transferred image obtained had a sufficiently high density, without fog at all, being also free from scattering of the toner around the images, to give a good image with high resolution. Transferred images were formed continuously by use of the above developer for examination of its performance under successive copying operations to give the result that the transferred image after copying 10000 sheets was found to be totally comparable to the images at the initial stage.

When the environmental conditions were changed to 35° C. and 85% R.H., the image density was substantially unchanged from that obtained under normal temperature and normal humidity conditions, and clear electrostatic images could be obtained without fog and scattering. Performance under successive copying was substantially unchanged up to 10000 sheets of copying. Then, when transferred images were obtained at a low temperature and a low humidity of 10° C. and 10%, the image densities were found to be high, and the solid black portions could be developed and transferred very smoothly to give excellent images without scattering or drop-off of the toner. When successive copying was conducted under these environmental conditions, both continuously and intermittently, the density fluctuation was within ±0.2 up to 10000 sheets of copying, thus showing that the developer was satisfactory in practical applications.

EXAMPLE 2C

In place of the compound (1) in Example 1C, a compound (2) shown below was prepared, and a toner was prepared similarly as in Example 1C by use of this compound (2).

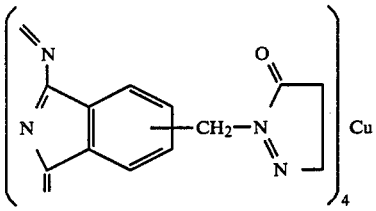

The above toner was placed in a developing device as shown in FIG. 1 and development and transfer were conducted as described in Example 1C.

Good results substantially the same as in Example 1 could be obtained.

EXAMPLE 3C

Using the toner of Example 1C, an electrostatic latent image on the electrostatic image bearing member was developed by means of the device shown in FIG. 2 similarly as in Example 4B.

Good results substantially the same as in Example 1C could be obtained.

EXAMPLE 4C

Using the toner of Example 1C, an electrostatic latent image on the electrostatic image bearing member was developed by means of the device shown in FIG. 3 similarly as in Example 5B.

Good results substantially the same as in Example 1C could be obtained.

EXAMPLE 5C

Using the toner of Example 1C, an electrostatic latent image on the electrostatic image bearing member was developed by means of the device shown in FIG. 4 similarly as in Example 6B.

Good results substantially the same as in Example 1C could be obtained.

EXAMPLE 6C

Using the toner of Example 1C, an electrostatic latent image on the electrostatic image bearing member was developed by means of the device shown in FIG. 5 similarly as in Example 7B.

Good results substantially the same as in Example 1C could be obtained.

EXAMPLE 1D

The zinc oxide binder type drum-shaped photosensitive member prepared similarly as in Example 1B was subjected to corona discharging at ⊖6 KV to be charged uniformly over the whole surface, followed by irradiation of the original image to form an electrostatic latent image.

The toner carrying member was made of a stainless steel cylindrical sleeve of 50 mm in outer diameter in the structure as shown in FIG. 6. The magnetic density on the sleeve surface was 70.0 Gauss, and the distance between the doctor blade and the sleeve distance was 0.2 mm. This rotatory sleeve-fixed magnet type developer (circumferential speed of the sleeve is the same as the drum, with opposite rotatory direction) was operated with a distance of the above photosensitive drum surface and the sleeve surface set at 0.25 mm and by application of an alternate current voltage of 400 Hz, 1000 V and a direct current bias voltage of −150 V.

| | |
|---|---|
| Styrene-n-butyl methacrylate | 100 parts |
| Magnetite | 60 parts |
| Nigrosine | 2 parts |

were blended thoroughly in a blender, followed by kneading on twin rolls heated to 150° C. The kneaded product was left to cool, coarsely crushed by a cutter mill, pulverized by means of a micropulverizer with a jet air stream and further subjected to classification by use of a wind force classifier to obtain fine powder of 5 to 20μ.

The treated fine particles of silica prepared similarly as in Example 1 were added in an amount of 0.8% by weight to the above fine powder and mixed in a Henschel mixer to obtain a developer.

Development was conducted with this developer, using the developing device as described above. Subsequently, the powder image was transferred while irradiating direct current of corona of ⊖7 KV on the backside of transfer paper to obtain a copied image. Fixing was performed by means of a commercially available plain paper copying machine (trade name: NP-5000, produced by Canon K.K.).

The transferred image obtained had a sufficiently high density of 1.38, without fog at all, being also free from scattering of the toner around the images, to give a good image with high resolution.

Transferred images were formed continuously by use of the above developer for examination of its performance under successive copying operations to give the result that the transferred image after copying 20000 sheets was found to be totally comparable to the images at the initial stage.

When the environmental conditions were changed to 35° C. and 85% R.H., the image density was substantially unchanged from that at normal temperature and normal humidity, namely 1.30, and clear images could be obtained without substantial change in performance in successive copying up to 30000 sheets of copying. Then, when transferred images were obtained at a low temperature and a low humidity of 10° C. and 10%, the image densities were found to be as high as 1.50, and the solid black portions could be developed and transferred very smoothly to give excellent images without scattering or drop-off of the toner. When successive copying was conducted under these environmental conditions, both continuously and intermittently, the density fluctuation was within ±0.2 up to 10000 sheets of copying, thus showing that the developer was satisfactory in practical applications.

COMPARATIVE EXAMPLE 1D

A developer was prepared in the same manner as in Example 1D except that the fine silica particles Aerosil 200 were not treated with the silane coupling agent, and development and transfer were conducted similarly. As the result, only reversed images could be obtained, exhibiting negative charging characteristic.

EXAMPLE 2D

Example 1D was repeated except for using as the silane coupling agent N-(trimethoxysilylethyl)carbazole:

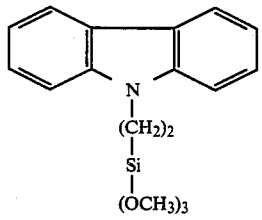

Substantially the same results as in Example 1D were obtained.

EXAMPLE 3D

Example 1D was repeated except for using as the silane coupling agent (trimethoxysilyl)guanamine:

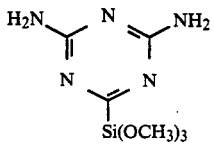

Good results substantially the same as in Example 1D were obtained.

EXAMPLE 1E

With the use of the compound (1) obtained in Example 1C, a toner with an average particle size of 10 μm was prepared according to the following formulation:

| | |
|---|---|
| Styrene-n-butyl methacrylate | 100 parts |
| Magnetite | 60 parts |
| Compound (1) | 5 parts |

Development was conducted with this developer, using the same developing device as in Example 1D. Subsequently, the powder image was transferred while irradiating direct current of corona of ⊖7 KV on the backside of transfer paper to obtain a copied image. Fixing was performed by means of a commercially available plain paper copying machine (trade name: NP-5000, produced by Canon K.K.).

The transferred image obtained had a sufficiently high density of 1.45, without fog at all, being also free from scattering of the toner around the images, to give a good image with high resolution.

Transferred images were formed continuously by use of the above developer for examination of its performance under successive copying operations to give the result that the transferred image after copying 20000 sheets was found to be totally comparable to the images at the initial stage.

When the environmental conditions were changed to 35° C. and 85% R.H., the image density was substantially unchanged from that at normal temperature and normal humidity, namely 1.38, and clear images could be obtained without substantial change in performance in successive copying up to 30000 sheets of copying. Then, when transferred images were obtained at a low temperature and a low humidity of 10° C. and 10%, the image densities were found to be as high as 1.62, and the solid black portions could be developed and transferred very smoothly to give excellent images without scattering or drop-off of the toner. When successive copying was conducted under these environmental conditions, both continuously and intermittently, the density fluctuation was within ±0.2 up to 10000 sheets of copying, thus showing that the developer was satisfactory in practical applications.

EXAMPLE 2E

When Example 1E was repeated except for using a compound (2) as shown below in place of the compound (1), good results were obtained.

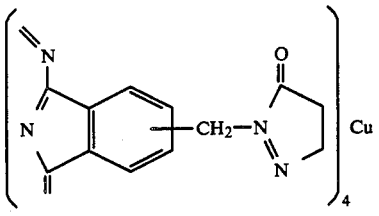

What is claimed is:

1. A dry developing method, which comprises:

(a) disposing an electrostatic image bearing member having an electrostatic image on its surface and a developer carrying member having a surface for carrying an insulating dry developer thereon with a gap between said electrostatic image bearing member and said developer carrying member; and (b) coating said insulating dry developer on said developer carrying member, wherein said insulating dry developer is positively chargeable and comprises toner particles containing a binder resin and a colorant or a magnetic powder, and fine silica particles treated with a nitrogen-containing silane coupling agent represented by the formula:

$R_mSiY_n$ wherein R is an alkoxy group or chlorine, m is an integer of from 1 to 3, Y is an unsaturated nitrogen-containing heterocyclic group or derivative thereof, and n is an integer of from 1 to 3, wherein m+n is 4; and (c) bringing the coated insulating developer to said gap, wherein the insulating developer on said developer carrying member surface at said gap has a thickness thinner than said gap and causing the insulating developer to jump to the electrostatic image to effect development.

2. A developing method according to claim 1, wherein said insulating developer contains carrier particles.

3. A developing method according to claim 1, wherein said unsaturated nitrogen-containing heterocyclic group is selected from the group consisting of:

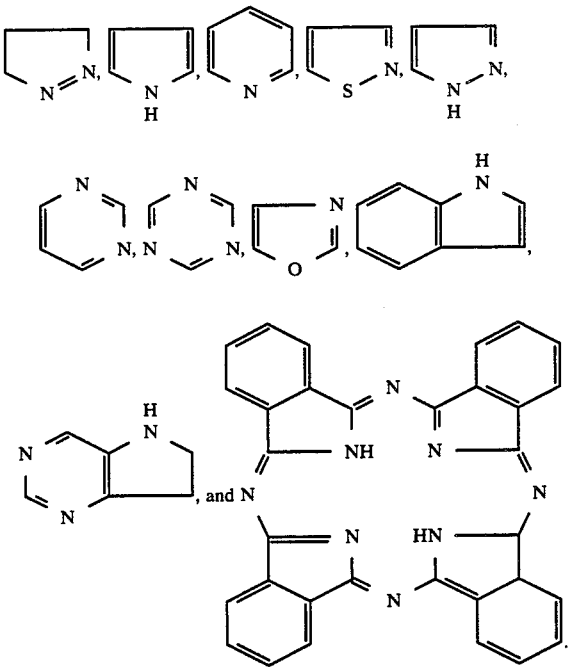

4. A developing method according to claim 1, wherein said insulating developer has a saturation magnetization of 10 emu/g or less at an external magnetic field of 5000 Oersted and is substantially non-magnetic.

5. A developing method according to claim 1, wherein the developer is magnetic.

6. An insulating, positively chargeable dry developer comprising (i) toner particles containing a binder resin and a colorant or a magnetic powder and (ii) fine silica particles treated with a nitrogen-containing silane coupling agent represented by the formula:

$R_mSiY_n$ wherein R is an alkoxy group or chlorine, m is an integer of from 1 to 3, Y is an unsaturated nitrogen-containing heterocyclic group or derivative thereof and n is an integer of from 1 to 3, wherein m+n is 4.

7. A developer according to claim 6, wherein said unsaturated nitrogen-containing heterocyclic group is selected from the group consisting of:

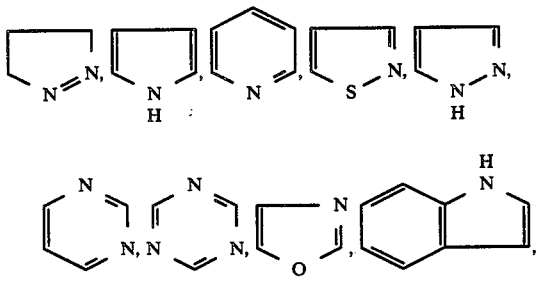

-continued

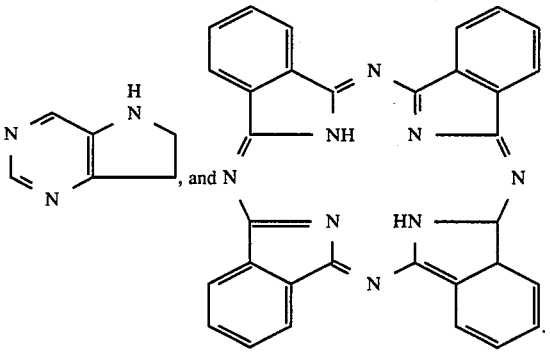

8. A developer according to claim 6, wherein the developer contains carrier particles.

9. A developer according to claim 6, wherein said silica particles are fumed silica particles resulting from vapor phase oxidation of silicon halide.

10. A developing method according to claim 1, wherein the toner particles have 0.01 to 3% by weight of the fine silica particles treated with the nitrogen-containing silane coupling agent.

11. A developer according to claim 6, wherein the toner particles have 0.01 to 3% by weight of the fine silica particles treated with the nitrogen-containing silane coupling agent.

* * * * *

UNITED STATES PATENT AND TRADEMARK OFFICE

CERTIFICATE OF CORRECTION

PATENT NO. : 4,680,245

DATED : July 14, 1987

INVENTOR(S) : KOSHI SUEMATSU, ET AL.

It is certified that error appears in the above-identified patent and that said Letters Patent is hereby corrected as shown below:

AT [54] IN THE TITLE

Lines 3-4, "NITROGEN CONTAINING" should read --NITROGEN-CONTAINING--.

AT [56] UNDER REFERENCES CITED/U.S. PATENT DOCUMENTS

Line 1, "3,229,419 4/1973 Honjo et al. ....430/115" should read --3,729,419 4/1973 Honjo et al. ....430/115--.

COLUMN 7

Line 27, "N=N- azoxy" should read $$\begin{array}{l} \text{N=N-} \\ \downarrow \\ \text{O} \end{array}$$

-- $\begin{array}{l} \text{-N=N-} \\ \downarrow \\ \text{O} \end{array}$ azoxy--.

COLUMN 8

Line 41, "-CO- $\rangle$CO" should read -- -CO-, $\rangle$CO--.

COLUMN 12

Line 42, "copolymer styrene-maleic" should read --copolymer, styrene-maleic--.

UNITED STATES PATENT AND TRADEMARK OFFICE

CERTIFICATE OF CORRECTION

PATENT NO. : 4,680,245

DATED : July 14, 1987

INVENTOR(S) : KOSHI SUEMATSU, ET AL.

It is certified that error appears in the above-identified patent and that said Letters Patent is hereby corrected as shown below:

COLUMN 13

Line 60, "static bearing" should read --static image bearing--.

COLUMN 14

Line 29, "member face" should read --member 11 face--.

Signed and Sealed this

Fifth Day of January, 1988

*Attest:*

DONALD J. QUIGG

*Attesting Officer*

*Commissioner of Patents and Trademarks*